US007398046B2

(12) United States Patent
Kojima

(10) Patent No.: US 7,398,046 B2
(45) Date of Patent: Jul. 8, 2008

(54) PROCESS CARTRIDGE AND IMAGE FORMING APPARATUS CLEANING METHOD AND CLEANING DEVICE WITH IMPROVED LUBRICITY

(75) Inventor: Noriaki Kojima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 101 days.

(21) Appl. No.: 11/219,672

(22) Filed: Sep. 7, 2005

(65) Prior Publication Data

US 2006/0216082 A1 Sep. 28, 2006

(30) Foreign Application Priority Data

Mar. 28, 2005 (JP) ..... P2005-091069

(51) Int. Cl.
*G03G 21/00* (2006.01)

(52) U.S. Cl. ..... 399/350; 399/354; 399/358; 399/360

(58) Field of Classification Search ..... 399/71, 399/129, 343, 346, 350, 354, 358, 360
See application file for complete search history.

(56) References Cited

U.S. PATENT DOCUMENTS 5,344,733 A * 9/1994 Suzuki et al.
5,991,568 A * 11/1999 Ziegelmuller et al.
2003/0118371 A1* 6/2003 Sanmonji ..... 399/129
2003/0219664 A1* 11/2003 Ohkura et al.
2006/0291885 A1* 12/2006 Radulski et al. ..... 399/71
2007/0014605 A1* 1/2007 Facci et al. ..... 399/346

FOREIGN PATENT DOCUMENTS

JP A-64-090479 4/1989
JP A-03-180884 8/1991
JP A-04-005679 1/1992
JP A-8-176293 7/1996
JP A-8-208820 8/1996
JP A-10-143039 5/1998
JP A-11-38656 2/1999
JP A-11-184106 7/1999
JP A-11-316468 11/1999
JP A-2003-330318 11/2003
JP 2005189594 A * 7/2005

* cited by examiner

*Primary Examiner*—David M. Gray
*Assistant Examiner*—Laura K Roth
(74) *Attorney, Agent, or Firm*—Morgan, Lewis & Bockius LLP

(57) ABSTRACT

A process cartridge detachably mounted on an image forming apparatus, includes a cleaning blade which comes into contact with a surface of a member to be cleaned incorporated in the image forming apparatus and removes a residual toner adhering to the surface, and a toner feeding unit which is disposed on the cleaning blade at a side where the residual toner adheres to the surface and re-adheres the residual toner having been removed from the surface to the surface.

23 Claims, 9 Drawing Sheets

FIG. 8

| | EXAMPLE 1 | EXAMPLE 2 | EXAMPLE 3 | EXAMPLE 4 | EXAMPLE 5 | COMPARATIVE EXAMPLE 1 | COMPARATIVE EXAMPLE 2 |
|---|---|---|---|---|---|---|---|
| PHOTO-SENSITIVE MATERIAL | A | A | A | B | C | A | C |
| ABRASION AREA OF EDGE ($\mu m^2$) | 8 | 8 | 8 | 6 | 10 | 50 | (IMPOSSIBLE TO DRIVE, DUE TO TURNING-UP) |
| FAULTY CLEANING | NOT OBSERVED | NOT OBSERVED | NOT OBSERVED | NOT OBSERVED | NOT OBSERVED | OBSERVED | (UNABLE TO EVALUATE, DUE TO TURNING-UP) |
| TURNING-UP OF BLADE | NOT OBSERVED | NOT OBSERVED | NOT OBSERVED | NOT OBSERVED | NOT OBSERVED | NOT OBSERVED | OBSERVED |

PROCESS CARTRIDGE AND IMAGE FORMING APPARATUS CLEANING METHOD AND CLEANING DEVICE WITH IMPROVED LUBRICITY

BACKGROUND OF THE INVENTION

1. Field of the Invention

The present invention relates to an electrophotographic image forming apparatus for a copying machine, a printer, a facsimile, or a multifunction apparatus having functions of these devices, or the like.

2. Description of the Related Art

In general, in an electrographic method, an electrostatic recording method, or the like, an electrostatic latent image is formed on an image carrier, such as a photosensitive drum, and the electrostatic latent image is formed into a visible image with use of a toner serving as a developing agent. The thus-visualized toner image is subjected to a transfer process and a fixation process, whereby an image is formed on recording paper (a recording material, a recording medium, paper). In such an image forming method, residual toner (remaining toner) usually remains on an image carrier after a transfer process. Accordingly, a cleaning device for cleaning the residual toner is disposed.

Cleaning devices of various types have been known as such a cleaning device. Typical examples thereof include a cleaning device of blade-cleaning type, in which a cleaning blade made from a contact plate usually having elasticity is disposed so as to come into contact with an image carrier, to thus cause the cleaning blade to scrape residual toner from the image carrier. In this blade-cleaning method, since a cleaning blade comes into contact with a surface of an image carrier, such as a photosensitive drum, to thus be rub the same, an edge of the cleaning blade for scraping toner becomes worn.

In addition, in, e.g., a lower-speed or a medium-speed apparatus, an electrifying device of a contact type, such as a charging roll, is generally employed as an electrifying member. A reason why such an electrifying device is employed is that the electrifying device produces a drastically smaller amount of ozone as compared with an on-contact-type electrifying device, such as a so-called corotron charging device, thereby being friendly to the environment. Moreover, other reasons for employing the contact-type electrifying device include ready realization of miniaturization and cost reduction, since neither an ozone filter nor an air blower is necessary.

Meanwhile, there arises a problem that an amount of corona products adhering to a photosensitive drum is drastically increased as compared with a non-contact-type electrifying device. The cause thereof is that a contact-type electrifying device produces a smaller absolute amount of corona products than does a non-contact-type electrifying device, however, a discharge region of the former is in very close proximity to a photosensitive drum. Accordingly, when a cleaning blade is employed in a contact-type electrifying device, in addition to abrasion of the cleaning blade caused by an increase in frictional coefficient, problems of chipping and turning-up of the same arise, along with an increase in torque of a photosensitive-material-driving section.

Meanwhile, for the purpose of increasing abrasion resistance of a photosensitive drum, an image carrier whose outermost surface layer contains a charge-transport material and a siloxane resin, and which is of high mechanical strength, has hitherto been disclosed (see, e.g., JP-A-11-38656, JP-A-11-184106, or JP-A-11-316468). These image carriers having high mechanical strength exhibit a tendency such that corona products having been effectively removed by means of abrasion in a related-art image carrier are less-easily removed, thereby increasing friction to a large extent, to thus further exacerbate damage to a blade.

A variety of methods for suppressing abrasion, chipping, and turning-up of a cleaning blade and an increase in a torque or a photosensitive-material-driving section have hitherto been proposed.

There has been known a method of, for the purpose of maintaining lubricity between the surface of a photosensitive material and a cleaning blade, periodically producing a toner band on a region where no image is to be formed and supplying the same to a blade edge (see, e.g., JP-A-4-005679 (pages 2 to 3, FIG. 1) or JP-A-3-180884 (page 3, FIG. 2)). A method of supplying lubricant to the surface of a photosensitive material byway of a lubricant-application member has also been known (see, e.g., JP-A-2003-330318 (page 5, FIG. 3)).

In addition to the above, there has been known a method of, for the purpose of reducing a frictional force with respect to a cleaning blade, rubbing the surface of an image carrier with a magnetic brush or a sponge roll containing a polishing agent, thereby removing corona products from the surface of the image carrier (see, e.g., JP-A-10-143039 (page 4, FIG. 2) or JP-A-10-143039 (page 4, FIG. 2)).

However, according to JP-A-4-005679 or JP-A-3-180884, an amount of toner to be consumed will be increased by an amount for producing the toner band, which is required in addition to that for forming a desired image, which is unfavorable.

According to JP-A-2003-330318, JP-A-10-143039, or JP-A-10-143039, cost is increased for disposing lubricant-application means and corona-products-removal means, and a problem of space saving also arises.

SUMMARY OF THE INVENTION

According to an aspect of the present invention, a process cartridge detachably mounted on an image forming apparatus includes a cleaning blade which comes into contact with a surface of a member to be cleaned incorporated in the image forming apparatus and removes a residual toner adhering to the surface, and a toner feeding unit which is disposed on the cleaning blade at a side where the residual toner adheres to the surface, and re-adheres the residual toner having been removed from the surface to the surface.

According to an aspect of the present invention, an image forming apparatus that performs image forming by means of transferring and fixing onto a recording medium a toner image carried on a carrier, includes a cleaning blade which comes into contact with a surface of a member to be cleaned incorporated in the image forming apparatus main body thereby removing residual toner adhering to the surface to perform cleaning, and a toner feeding unit which is disposed on a side of the cleaning blade where the residual toner adheres to the surface and which causes the residual toner having been removed from the surface to re-adhere to the surface.

According to an aspect of the present invention, a cleaning method includes a feeding step of feeding an adhesion substance to a not-yet-cleaned region on a surface of a member to be cleaned, and a cleaning step of cleaning the not-yet-cleaned region to which the adhesion substance has been fed in the feeding step by means of a cleaning blade which comes into contact with the surface of the member to be cleaned.

According to an aspect of the present invention, a cleaning device includes a cleaning blade which comes into contact with a surface of a member to be cleaned thereby removing a adhesion substance adhering to the surface to perform cleaning, and a feeding unit which is disposed on a side of the cleaning blade where the adhesion substance adheres to the surface and which feeds the adhesion substance to the surface.

BRIEF DESCRIPTION OF THE DRAWINGS

Embodiments of the present invention will be described in detail based on the following figures, wherein:

FIG. 8 is a table for indicating results of Examples and Comparative Examples.

DETAILED DESCRIPTION OF THE INVENTION

Hereinafter, embodiments of the invention will be described in detail by reference to the appended drawings. Meanwhile, embodiments utilizing the present invention are described, and the present invention is not to be limited to the embodiments, so long as a method falling within the scope of the invention is employed.

First Embodiment

Figure 1:
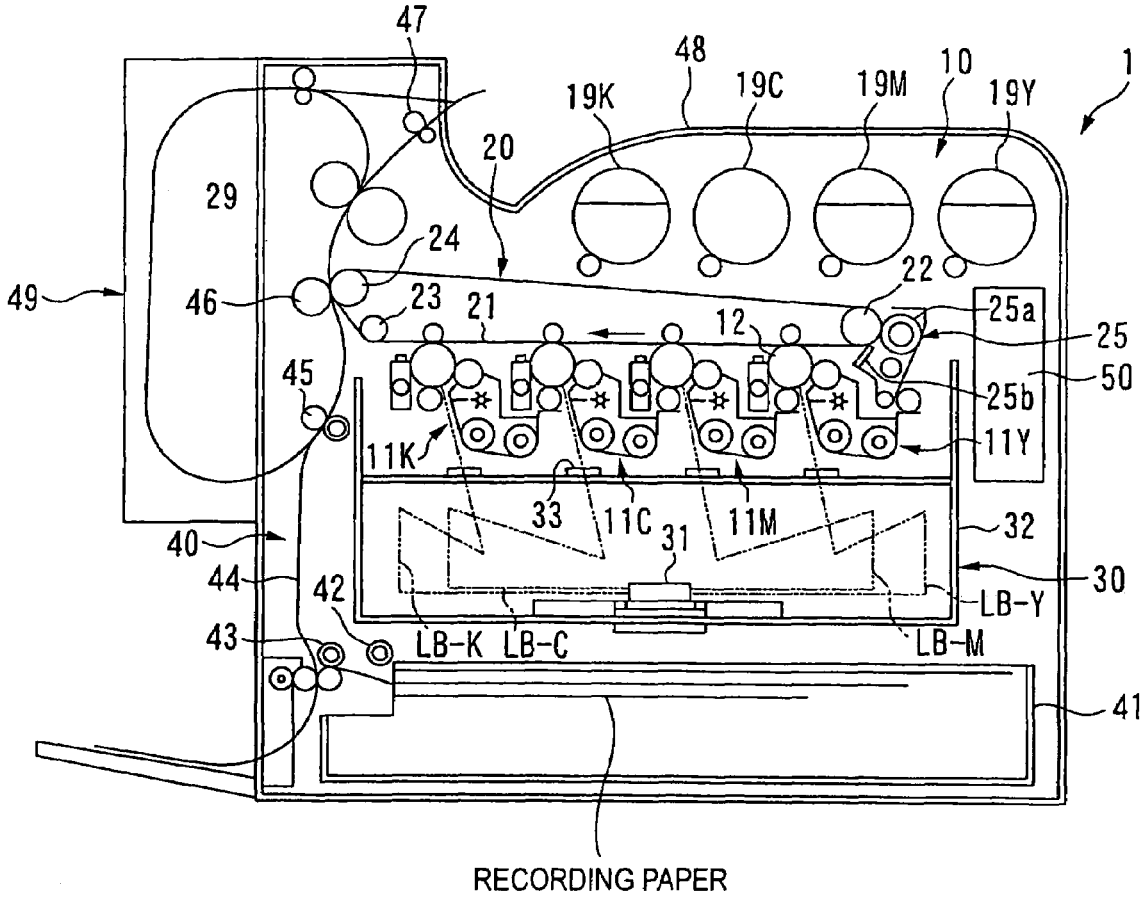
FIG. 1 is a diagram showing the overall configuration of an image forming apparatus to which a first embodiment of the invention is applied.

FIG. 1 is a diagram showing the overall configuration of an image forming apparatus according to a first embodiment. The image forming apparatus shown in FIG. 1 is a so-called tandem-type digital color printer. The image forming apparatus includes a main body 1, an image forming processing section 10 for performing image forming in accordance with gradation data pertaining to respective colors, and a sheet-transport section 40 for transporting recording paper (recording sheets) The main body 1 has an IPS (image processing system) 50 serving as an image processing section which is connected to, e.g., a personal computer, an image reading device, or the like, thereby performing predetermined image processing pertaining to received image data.

The image forming processing section 10 includes four image forming units (image forming engines) 11Y, 11M, 11C, and 11K; a transfer unit 20; and an ROS (raster output scanner) 30. The image forming units 11Y, 11M, 11C, and 11K, which are constituted of yellow (Y), magenta (M), cyan (C), and black (K), are arranged in parallel with each other with a predetermined gap therebetween in the horizontal direction. The transfer unit 20 performs multiple transfer, onto an intermediate transfer belt 21, of respective color toner images formed on photosensitive drums of the image forming units 11Y, 11M, 11C, and 11K. The ROS 30 is an optical system unit for radiating laser beams onto the image forming units 11Y, 11M, 11C, and 11K. In addition, on the main body 1, there is disposed a fuser 29 for fusing, onto a recording paper (sheet) by means of heat and pressure, an image having been secondarily transferred onto the recording paper by the transfer unit 20. Furthermore, there are disposed toner cartridges 19Y, 19M, 19C, and 19K for feeding toner of the respective colors to the image forming units 11Y, 11M, 11C, and 11K.

The transfer unit 20 includes a driving roll 22 for driving the intermediate transfer belt 21 serving as an intermediate transfer member; a tension roll 23 for exerting a predetermined tension onto the intermediate transfer belt 21; a back-up roll 24; and a belt-cleaning device 25 for removing residual toner, and the like, present on the intermediate transfer belt 21. The back-up roll 24 secondarily transfers to recording paper respective color toner images to which is applied a bias of the same polarity as a charged polarity of the toner, and which are superimposed on each other. The intermediate transfer belt 21 is spanned around the driving roll 22, the tension roll 23, and the back-up roll 24 with a predetermined tension. The intermediate transfer belt 21 is circulatory driven in the direction indicated by an arrow at a predetermined speed by the driving roll 22, which is rotationally driven by means of a dedicated drive motor (not shown) which exhibits excellent performance in maintaining constant speed. A belt whose resistance is adjusted by, e.g., a belt material (a rubber or a resin) which does not induce charge accumulation, is used for the intermediate transfer belt 21. The belt-cleaning device 25 includes a cleaning brush 25*a* and a cleaning blade 25*b*. The belt-cleaning device 25 causes the cleaning brush 25*a* and the cleaning blade 25*b* to remove residual toner, paper powder, and the like, from the surface of the intermediate transfer belt 21 after completion of a transfer process of toner images, thereby preparing for the subsequent image forming process.

The ROS 30 includes, in addition to an unillustrated semiconductor laser and a modulator, a polygon mirror 31 for performing deflection scanning of laser beams (LB-Y, LB-M, LB-C, and LB-K) emitted from the semiconductor laser. The example shown in FIG. 1 involves a potential risk of being stained by a fall of toner, and the like, since the ROS 30 is disposed below the image forming units 11Y, 11M, 11C, and 11K. To this end, the ROS 30 is provided with a rectangular solid frame 32 for sealing the respective components. In addition, glass windows 33, through which the laser beams (LB-Y, LB-M, LB-C, and LB-K) pass through, are disposed at elevated positions within the frame 32. Thus, the ROS 30 is configured so as to increase shielding effects in addition to performing scanning exposure.

The sheet-transport section 40 includes a paper feed device 41 for loading recording paper (sheet)—on which an image is to be recorded—and feeding the same; a nudger roll 42 for picking up recording paper from the paper feed device 41 and feeding the same; a feed roll 43 for separating an individual sheet of the recording paper fed from the nudger roll 42 and transporting the same; and a transport path 44 for transporting to an image transfer section the individual sheet of recording paper having been separated by the feed roll 43. In addition, the sheet transport system 40 includes a registration roll 45 and a secondary transfer roll 46. The registration roll 45 transports recording paper having been transported by way of the transport path 44 toward a secondary transfer position while adjusting timing. The secondary transfer roll 46, which is disposed in the secondary transfer position in a grounded state, comes into press contact with the back-up roll 24, thereby secondarily transferring an image on the recording paper. Furthermore, the sheet transport system 40 has a discharge roll 47 for discharging to the outside of the main body 1 recording paper on which a toner image has been fused by means of the fuser 29; and a discharge tray 48 on which recording paper discharged by the discharge roll 47 is stacked. In addition, the sheet transport section 40 has a double-sided-recording transport unit (hereinafter called a "double-sided transport unit") 49 which reverses recording paper fused by the fuser 29, thereby allowing double-sided recording.

Next, the image forming units 11Y, 11M, 11C, and 11K in the image forming processing section 10 will be described in detail.

Figure 2:
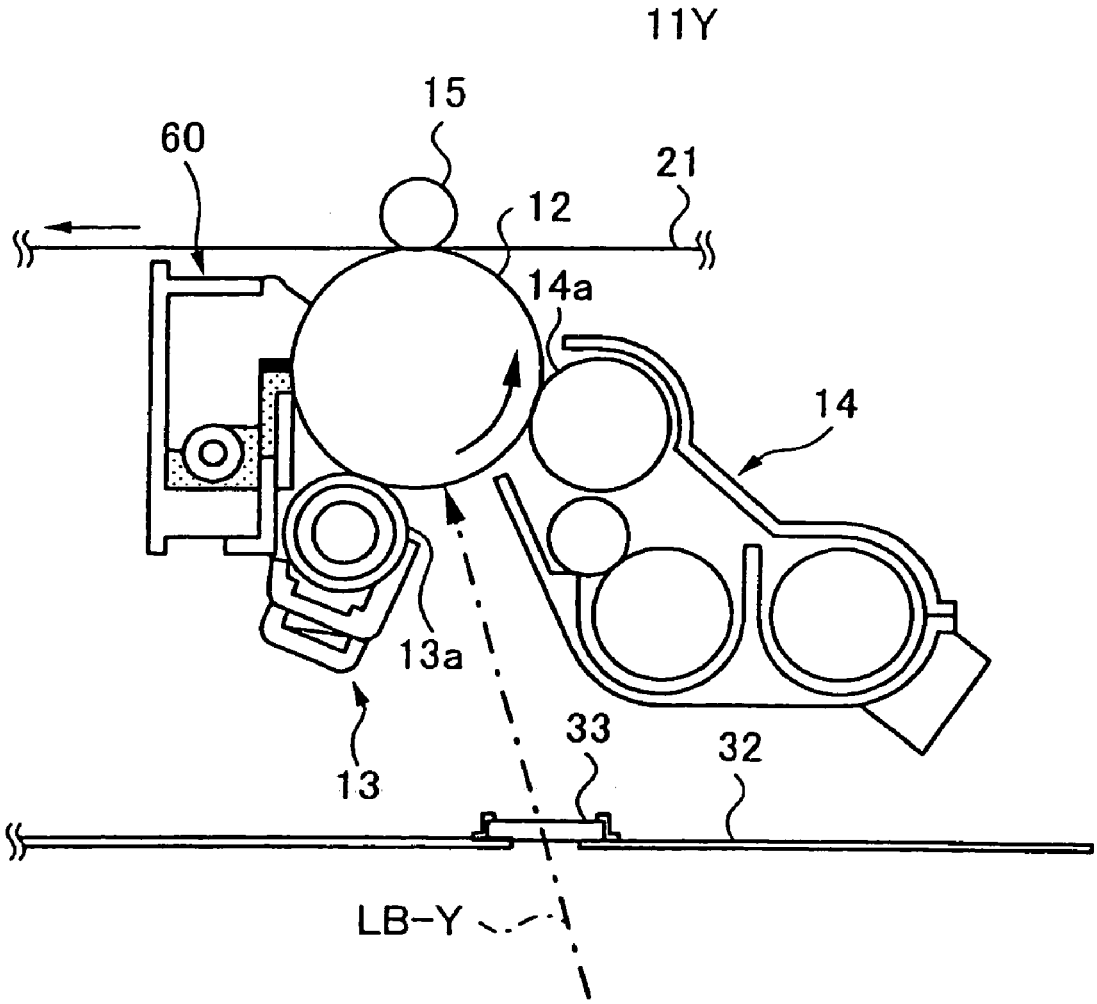
FIG. 2 is a view for explaining the configuration of an image forming unit.

FIG. 2 is a view for explaining the configurations of the image forming units 11Y, 11M, 11C, and 11K. FIG. 2 shows the image forming unit 11Y of yellow (Y). However, the other image forming units 11M, 11C, and 11K are configured in substantially the same manner.

Each of the image forming units 11Y, 11M, 11C, and 11K includes a photosensitive drum 12 serving as an image carrier on which a toner image is to be carried; a contact-type electrifying device 13 which charges the photosensitive drum 12 with use of a charging roll 13*a*; a developing device 14; a primary transfer roll 15, and a cleaning device 60. The developing device 14 develops an electrostatic latent image—charged by the electrifying device 13, and formed on the photosensitive drum 12 by means of the laser beams (LB-Y, LB-M, LB-C, and LB-K) from the ROS 30—with use of toner (of, e.g., negative polarity) on a developing roll 14*a*. The primary transfer roll 15 is disposed so as to oppose the photosensitive drum 12 with the intermediate transfer belt 21 therebetween, and transfers onto the intermediate transfer belt 21 a toner image developed on the photosensitive drum 12. The cleaning device 60 removes residual toner remaining on the photosensitive drum 12 after transfer operation.

Here, some elements of each of the image forming units 11Y, 11M, 11C, and 11K may be formed as a cartridge. Several modes are conceivable for a process cartridge [CRU (customer replaceable unit)] formed into a cartridge; and an example thereof will be described hereinbelow. First, forming the cleaning device 60 into a cartridge is conceivable (a first process cartridge). Integrating the photosensitive drum 12, the electrifying device 13, and the cleaning device 60, thereby forming the same into a cartridge, is also conceivable (a second process cartridge). Furthermore, integrating the photosensitive drum 12, the electrifying device 13, the developing device 14, and the cleaning device 60, thereby forming the same into a cartridge, is also conceivable (a third process cartridge).

Additional descriptions will be given to the case where the image forming units are formed into a cartridge. The main body 1 and the respective process cartridges are configured so that the respective process cartridges of the image forming units 11Y, 11M, 11C, and 11K are independently detachable with respect to the main body 1 of the image forming apparatus. In addition, a non-volatile memory (not shown) can be mounted on each of the process cartridges. When the non-volatile memory is mounted, historical information pertaining to cartridge usage while the cartridge is attached, such as a number of revolutions of the photosensitive drum 12, an accumulated time during which high voltage is applied, and/or a total number of printed sheets, can be stored in the non-volatile memory. Each of these cartridges can be used while being interchanged among the image forming units 11Y, 11M, 11C, and 11K. By virtue of a non-volatile memory being mounted on each of the process cartridges, even when a process cartridge is used in different units, the process cartridge per se can store its own usage history information. As a result, determination of, e.g., a proper useful life can be made on the basis of individual process cartridges.

Next, operations of the image forming apparatus illustrated in FIG. 1 will be described. An image of light reflected from color materials of a document having been read by an unillustrated document reader, color-material image data formed by an unillustrated personal computer, etc., and the like, is input into the IPS 50 in the form of, e.g., 8-bit reflectance data pertaining to each of R (red), G (green), and B (blue). In the IPS 50, the thus-input reflectance data are subjected to predetermined image processing, such as any of a variety of image editing processes; e.g., shading correction, misregistration correction, lightness/color space conversion, gamma control, erasure of frame, color edition, move-edition, and/or the like. The image data having been subjected to image processing are converted into color-material gradation data pertaining to four colors constituted of yellow (Y), magenta (M), cyan (C), and black (K), thereby being output to the ROS 30.

The ROS 30 causes laser beams (LB-Y, LB-M, LB-C, and LB-K) having been radiated from the semiconductor laser (not shown) to exit to the polygon mirror 31 by way of an f-θ lens (not shown) in accordance with the thus-input color-material gradation data. The polygon mirror 31 modulates the thus-incident laser beams in accordance with gradation data pertaining to each color; performs deflecting-scanning; and radiates the laser beams onto the photosensitive drums 12 of the image forming units 11Y, 11M, 11C, and 11K by way of an unillustrated imaging lens and plural mirrors. On the photosensitive drums 12 of the image forming units 11Y, 11M, 11C, and 11K, charged surfaces are subjected to scanning exposure, whereby electrostatic latent images are formed. The thus-formed electrostatic latent images are developed as toner images of respective colors constituted of yellow (Y), magenta (M), cyan (C), and black (K) by the respective image forming units 11Y, 11M, 11C, and 11K.

A voltage of a polarity (positive polarity) opposite that of the charged electrode (negative polarity) of the toner is applied to the primary transfer roll 15, whereby the toner images formed on the photosensitive drums 12 of the image forming units 11Y, 11M, 11C, and 11K are subjected to multiple transfer onto the intermediate transfer belt 21 serving as the intermediate transfer member. At this time, the black image forming unit 11K for forming a black toner image is disposed furthest downstream in the moving direction of the intermediate transfer belt 21. Thus, primary transfer of the black toner image on the intermediate transfer belt 21 is performed last.

Meanwhile, in the sheet transport section 40, the nudger roll 42 rotates while its timing is adjusted to image forming operation; and recording paper of a given size is fed from the paper feed device 41. Recording paper, which is separated into independent sheets by the feed roll 43, is transported to the registration roll 45 by way of the transport path 44, and temporarily caused to stop. Thereafter, the registration roll 45 rotates while being adjusted to motion timing of the intermediate transfer belt 21 on which toner images are formed. As a result, the recording paper is transported to a secondary transport position formed by the back-up roll 24 and the secondary transfer roll 46. On the recording paper transported from below to above at the secondary transfer position, the toner images in which four colors are superimposed are sequentially transferred in a sub-scanning direction with use of a contact pressure and a predetermined electric field. Subsequently, the recording paper on which the respective color toner images are transferred is subjected to fixation processing by heat and pressure at the fuser 29, and thereafter discharged onto the discharge tray 48 disposed on the top of the main body 1 by the discharge roll 47. Meanwhile, the following configuration is also applicable. That is, instead of discharging the recording paper fused by the fuser 29 onto the discharge tray 48 as is, a transport direction of the recording paper is switched with use of an unillustrated switching gate, thereby causing the double-sided transport unit 49 to reverse the recording paper. By means of transporting the thus-reversed recording paper to the registration roll 45 and thereafter forming an image on the other side on which no printing is applied along the same flow as that previously-described, images can be formed on both sides of the recording paper.

Figure 3:
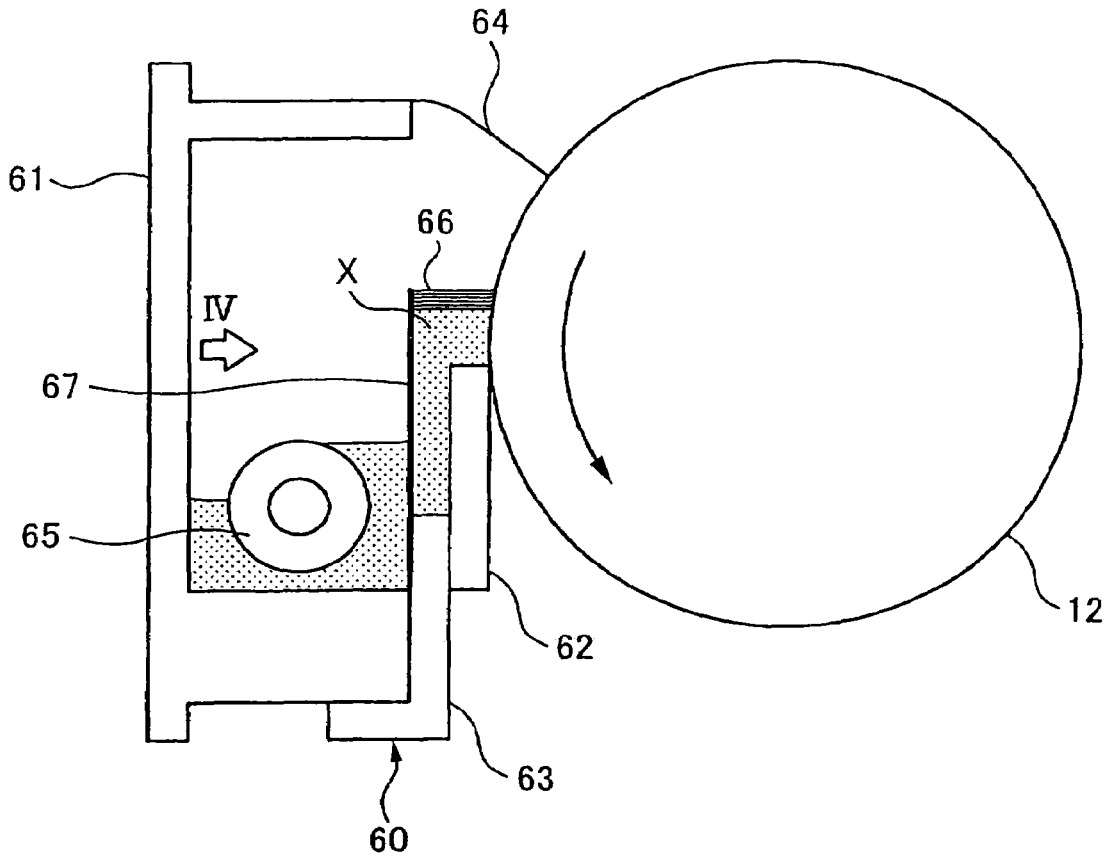
FIG. 3 is a configuration diagram for explaining the configuration of a cleaning device.
Figure 4:
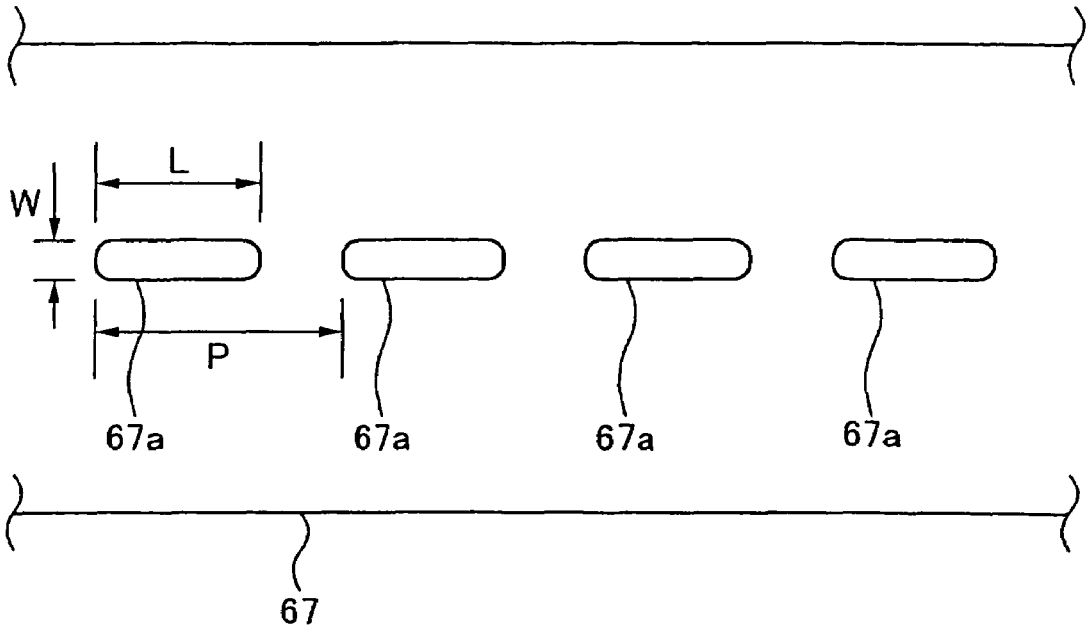
FIG. 4 is a configuration diagram for explaining the configuration of a toner-regulation member.

FIG. 3 is a configuration diagram for explaining the configuration of the cleaning device 60. FIG. 4 is a configuration diagram for explaining a toner-regulation member 67 of the cleaning device 60.

As shown in FIG. 3, the cleaning device 60 includes a cleaning case 61 having an opening opposing the photosensitive drum 12; and a cleaning blade 62 disposed at the opening of the cleaning case 61. The cleaning blade 62 comes into contact with the photosensitive drum 12, thereby performing cleaning of the photosensitive drum 12. In addition, the cleaning device 60 has a bracket 63 attached to the cleaning case 61; a film-like sealing member 64 disposed at the opening of the cleaning case 61; and a transport auger 65 for guiding waste toner stored in the cleaning case 61 to an unillustrated waste-toner container. The bracket 63 retains the cleaning blade 62 so that a contact-side edge of the cleaning blade 62 faces upstream with respect to a rotating direction of the photosensitive drum 12. The sealing member 64 comes into contact with the photosensitive drum 12 at a position upstream of the cleaning blade 62 with respect to the rotating direction of the photosensitive drum 12.

In addition, the cleaning 60, which is disposed in close proximity to the cleaning blade 62, includes a toner feeding section 66 for feeding toner to the photosensitive drum 12; and the toner-regulation member 67 for retaining toner to be fed to the photosensitive drum 12 by the toner feeding section 66.

The toner feeding section 66 is disposed at one end of the toner regulation member 67. The toner feeding section 66 is located at a position which is upstream of the cleaning blade 62 with respect to the rotating direction of the photosensitive drum 12, and which is downstream of the sealing member 64 with respect to the rotating direction of the photosensitive drum 12. In addition, the toner feeding section 66 has a conductive brush member to which is applied voltage of the same polarity as that of the toner. A tip of this brush member is in contact with the surface of the photosensitive drum 12. Meanwhile, as will be described later, the brush serving as one element of the toner feeding section 66 is provided not for scraping remaining toner from the surface of the photosensitive drum 12, but for charging toner.

The toner regulation member 67, which is a tabular member, is attached to the bracket 63 so as to prevent motion of the toner feeding section 66 with respect to the photosensitive drum 12. In addition, as shown in FIG. 3, toner obtained through cleaning is retained in a region X surrounded by the cleaning blade 62, the toner feeding section 66, and the toner regulation member 67. Plural notches 67*a* in the form of elongated holes are formed in the toner regulation member 67. Through the notches 67*a*, the toner retained in the region X is moved to the transport auger 65. Meanwhile, an example set of dimensions of the notch 67*a* is 3 mm in width W; 20 mm in length L; and 25 mm in pitch P.

Working effects of the cleaning device 60 configured as above will be described.

Toner scraped from the surface of the photosensitive drum 12 by means of the cleaning blade 62 is accumulated in the region X surrounded by the cleaning blade 62, the toner feeding section 66, and the toner regulation member 67. When toner, which exhibits negative polarity on the photosensitive drum 12, is scraped from the photosensitive drum 12 by the cleaning blade 62, the strength of its negative polarity is lowered. As a result, the toner becomes substantially non-charged. When such toner whose negative polarity is lowered in strength comes into contact with the toner feeding section 66 to which a voltage of the same polarity as that of the toner is applied, the toner is negatively charged again. The negatively-charged toner electrostatically adheres to the surface of the photosensitive drum 12 having positive polarity, and thereafter the toner is scraped from the surface of the photosensitive drum 12 by means of the cleaning blade 62. During operation of the image forming apparatus, the above-described operations are performed repeatedly.

In relation to the above, the toner functions as lubricant for appropriately reducing frictional force between the photosensitive drum 12 and the cleaning blade 62. The toner having such a function is negatively charged by the toner feeding section 66, and fed to the surface of the photosensitive drum 12. By virtue of this configuration, even when, e.g., images which are low in area coverage are continuously formed, increase in frictional force between the photosensitive drum 12 and the cleaning blade 62 can be prevented without employment of a toner band. Therefore, abrasion resistance of the cleaning blade 62 can be enhanced while suppressing the amount of toner to be consumed, thereby lengthening the useful lives of components of the cleaning blade 62.

Descriptions in this regard will be provided in further detail. When printing operation is continued in a state in which a remaining amount of toner in the photosensitive drum 12 is small, toner functioning as lubricant between the photosensitive drum 12 and the cleaning blade 62 is insufficient. Accordingly, since no toner to be scraped by the cleaning blade 62 from the surface of the photosensitive drum 12 is present, both the photosensitive drum 12 and the cleaning blade 62 become prone to damage. As a result, a problem of shortened useful-life arises, and in a severe case, a serious problem, such as peeling-off of the blade, can occur. In order to avoid occurrence of such circumstances, a method of feeding toner by use of a toner band (e.g., at a frequency of once per 70 sheets) has conventionally been proposed; however, there arises a problem of increasing an amount of toner to be consumed.

To this end, the present embodiment is configured so as to negate waste feed of toner due to a toner band, and the like. More specifically, the region X for temporarily storing toner recovered by the cleaning blade 62 is provided. Thus, for the purpose of reusing the toner stored in the region X, the toner is negatively charged by the toner feeding section 66, thereby causing the toner to re-adhere to the surface of the photosensitive drum 12.

From another viewpoint with regard to the configuration of the embodiment as described above, the toner feeding section 66 can be said to perform the same process as the developing process performed by the developing device 14. In addition, the toner feeding section 66 can be considered to serve as means for adjusting charge of toner.

Meanwhile, for the purpose of preventing a brush tip of the toner feeding section 66 from being pulled into a gap between the cleaning blade 62 and the photosensitive drum 62, e.g., the toner feeding section 66 and the cleaning blade 62 must be separated by a certain distance.

Hithertofore, the configuration and working effects of the present embodiment have been described. However, some modifications are conceivable. For instance, the film-like sealing member 64 is provided for preventing staining of the surroundings by the toner. However, the brush serving as an element of the toner feeding section 66 may provide the function of the film-like sealing member 64.

In the above, the case where the toner feeding section 66 is configured with a brush has been described. However, another member, such as a conductive film, may be employed in place of the brush. Alternatively, although there arises a problem in terms of a space and cost, a roll (e.g., the charging roll 13*a* of the electrifying device 13*a*) may be disposed in place of the brush.

In addition, in the present embodiment, the cleaning device 60 is used as a device for performing cleaning of the photosensitive drum 12. However, the same may be used in place of the belt-cleaning device 25 for cleaning the surface of the intermediate transfer belt 21. Alternatively, although another means for feeding toner is required, the cleaning device 60 may be used as a device for cleaning the surface of the transfer belt.

Alternatively, the following configuration is also conceivable. That is, an unillustrated toner feeding path in communication with the toner feeding section 66 is additionally disposed, whereby toner transported by way of the unillustrated toner feeding path, in addition to toner scraped by the cleaning blade 62, is used as toner to be charged by the toner feeding section 66.

In relation to the above, the cleaning blade 62 employed in the present embodiment is formed from an elastic material made of a polyurethane rubber. Examples of the polyurethane include ester polyurethanes and ether polyurethanes; with ester polyurethanes being preferable. Meanwhile, examples of polyisocyanate caused to react with a polyester polyol include 2,6-toluene diisocyanate (TDI), 4,4'-diphenylmethane diisocyanate (MDI), para-phenylenediamine (PPDI), 1,5-naphthalene diisocyanate (NDI), and 3,3-dimethyldiphenyl-4,4'-diisocyanate (TODI). In particular, 4,4'-diphenylmethane diisocyanate (MDI) is advantageous in terms of performance and cost.

In order to manufacture a urethane rubber from the above-mentioned polyester polyol, a polyisocyanate is mixed with a polyester polyol, and a short-chain polyol serving as a chain-lengthening agent, to thus cause reaction. As a method for causing reaction, a general method for manufacturing a polyurethane, such as a prepolymer process or a one-shot process, can be employed.

A contact pressure of the cleaning blade 62 with respect to the photosensitive drum 12 is set within a range of about 1.96 to $5.88\times10^{-2}$ N/mm (2.0 to 6.0 gf/mm).

Meanwhile, in the present embodiment, the cleaning devices 34 of the respective image forming units 11Y, 11M, 11C, and 11K employ identical cleaning blades 62. In addition, as the cleaning blade 25*b* to be employed in the belt-cleaning device 25, a cleaning blade which has the same physical properties as the cleaning blade 62 of the cleaning device 60 may be employed.

The toner to be employed in the embodiment is a toner whose shape coefficient SF is less than 140, where the shape coefficient SF of a true sphere is taken as 100. When the shape coefficient SF is 140 or greater, favorable transfer characteristics are less easily obtained, thereby posing difficulty in attaining higher quality of an image to be obtained. Meanwhile, in view of attaining higher image quality, a volume average particle size of the toner particle falls within a range of 2 to 8 μm.

The toner particles contain a binder resin and a coloring agent as essential components, and contain a releasing agent or a releasing-agent resin as desired. No specific limitation is imposed on the binder resin, and any binder resin having hitherto been employed in toner can be employed.

Specific examples of the binder resin include monopolymers of monomers including styrenes such as styrene, parachlorostyrene, and α-methylstyrene; acrylic monomers such as methyl acrylate, ethyl acrylate, n-propyl acrylate, lauryl acrylate, and 2-ethylhexyl acrylate; methacrylate monomers such as methyl methacrylate, ethyl methacrylate, n-propyl methacrylate, lauryl methacrylate, and 2-ethylhexyl methacrylate; ethylenically unsaturated acid monomers such as acrylic acid, methacrylic acid, and sodium styrene sulphonate; vinylnitriles such as acrylonitrile and methacrylonitrile; vinyl ethers such as vinylmethyl ether and vinyl isobutyl ether; vinyl ketones such as vinyl methyl ketone, vinyl ethyl ketone, and vinyl isopropenyl ketone; olefins such as ethylene, propylene, and butadiene; copolymers in which two or more of these monomers are combined; and mixtures thereof. Further examples include graft polymers obtained by polymerization of the above-listed monopolymer, copolymer, or mixture with a vinyl monomer under the presence of a non-vinyl condensation resin such as an epoxy resin, a polyester resin, a polyurethane resin, a polyamide resin, a cellulose resin, a polyether resin, or a mixture thereof, and the above-listed vinyl resin.

No specific limitation is imposed on the coloring agent, and any coloring agent having hitherto been known can be used. Examples of the coloring agent include a variety of pigments such as carbon black, chromium yellow, hanza yellow, benzidine yellow, indanthrene yellow, quinoline yellow, permanent orange GTR, pyrazolone orange, vulcan orange, watchung red, permanent red, brilliant carmine 3B, brilliant carmine 6B, Du Pont oil red, pyrazolone red, lithol red, rhodamine B lake, lake red C, rose bengal, aniline blue, ultramarine blue, Calico Oil blue, methylene blue chloride, phthalocyanine blue, phthalocyanine green, malachite green oxalate; and a variety of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes. These pigments and/or dyes can be used singly or in combination of two or more.

A releasing agent or a releasing-agent resin to be contained in the toner particles, as desired, may be added as a component of the binder resin. Examples of the releasing agent include low-molecular polyolefins such as polyethylene, polypropylene, and polybutene; silicones; fatty amides such as oleic acid amide, erucic acid amide, ricinoleic acid amide, stearic acid amide; vegetable waxes such as carnauba wax, rice wax, candelilla wax, Japan wax, and jojoba oil; animal waxes such as bees wax; and mineral or petroleum waxes such as montan wax, ozokerite, ceresin, paraffin wax, microcrystalline wax, and Fischer-Tropsch wax, as well as modifications thereof. At least one of the above is preferably contained in the toner particles.

The toner particles may contain a variety of components in addition to the above-listed components, for the purpose of controlling a variety of properties. For instance, when the toner particles are used as magnetic toner, the toner particles can be caused to contain a metal such as magnetic powder (of, e.g., ferrite or magnetite), reduced iron, cobalt, nickel, or manganese; an alloy thereof; or a chemical compound containing a metal among these. Furthermore, as required, a charge-control agent which is customarily employed, such as a quaternary ammonium base, a nigrosin compound, or a triphenylmethane pigment, may be appropriately selected and caused to be contained.

No specific limitations are imposed on a method for obtaining toner particles satisfying the above conditions. For instance, there can be employed a customarily employed pulverization method; a wet-melting granulation method in which toner particles are prepared in a dispersive medium; or a method for manufacturing toner in accordance with a known polymerization method, such as a suspension polymerization method, a dispersion polymerization method, or an emulsion aggregation method.

In addition, when inorganic fine particles, such as silica or titania having an average particle size of about 10 to 300 nm; abrasive powder of about 0.2 to 3 μm; and lubricant of about 3 to 5 μm are externally added to the toner particles appropriately, and the resultant mixture is mixed with a carrier formed from ferrite beads having an average particle size of 35 μm, or the like, a developing agent can be obtained.

In relation to the above, as an image carrier for use in the process cartridge or the image forming apparatus of the embodiment, a known photosensitive material, such as an organic photosensitive material, or an inorganic material such as an amorphous silicone photosensitive material or a selenium photosensitive material, may be employed. Among these, an organic photosensitive material is preferably employed, in view of having excellent advantages in terms of manufacturing, disposal, and the like.

No specific limitation is imposed on the organic photosensitive material, so long as at least a photosensitive layer is disposed on a conductive substrate. In the invention, the organic photosensitive material is preferably an organic photosensitive material having a separated-function-type photosensitive layer in which a charge generation layer and a charge transport layer are laminated, in this order. In addition, as required, on the surface of the photosensitive layer, a surface-protecting layer may be disposed; and/or an intermediate layer may be disposed between the photosensitive layer and the conductive substrate, or between the photosensitive layer and the surface-protecting layer.

Examples of the conductive substrate include a metal drum of aluminum, copper, iron, stainless steel, zinc, or nickel; conductive substrates obtained by means depositing a metal, such as aluminum, copper, gold, silver, platinum, palladium, titanium, nickel-chrome, stainless-steel, or copper-indium on a substrate in the form of, e.g., sheet, paper, plastic, or glass; those obtained by means of depositing a conductive metallic compound, such as indium oxide or tin oxide, on any of the above-listed substrates; those obtained by means of laminating a metal foil on one of the above-listed substrates; and those which have been subjected to conductive processing by means of dispersing carbon black, indium oxide, tin oxide-antimony oxide powder, metal power, or copper iodide in a binder resin, and applying the dispersion on one of the above-listed substrates. Meanwhile, the conductive substrate may be of any shape among a drum-like shape, a sheet-like shape, and a plate-like shape.

In addition, when a metal pipe substrate is employed as the conductive substrate, the surface of the metal pipe substrate may be the original pipe. However, surface treatment may alternatively be applied in advance so as to roughen the surface of the substrate. By virtue of the roughening treatment, when a coherent light source, such as a laser beam, is employed as an exposure light source, there can be prevented moire-like unevenness in concentration formed by coherent light, which may otherwise be generated within the photosensitive material. Examples of the surface treatment include mirror-surface grinding, etching, anodization, rough cutting, centerless grinding, sand blasting, and wet-honing.

In particular, the conductive substrate is preferably obtained by means of, e.g., anodizing a surface of an aluminum substrate, in view of enhancing adhesiveness with respect to a photosensitive layer and film-forming property.

The charge generation layer is formed by means of depositing a charge generation material in accordance with a vacuum evaporation method, or by means of applying coating with a solution containing an organic solvent and a binder resin.

Examples of the charge generation material include amorphous selenium, crystalline selenium, a selenium-tellurium alloy, a selenium-arsenic alloy, and other selenium compounds; inorganic photoconductors such as a selenium alloy, zinc oxide, and titanium oxide; those obtained by means of dye-sensitizing the same; a variety of phthalocyanine compounds such as an inorganic phthalocyanine, titanyl phthalocyanine, copper phthalocyanine, tin phthalocyanine, and gallium phthalocyanine; a variety of organic pigments such as squaliums, anthanthrones, perylenes, azos, anthraquinones, pyrenes, pyrylium salts, and thiapyrylium salts; and dyes.

These organic pigments generally have crystal forms of several types. In particular, various crystal forms, such as α-type or β-type, are known with regard to phthalocyanine compounds. However, a pigment of any crystal form can be employed, so long as it is sufficient in terms of sensitivity and other properties.

Meanwhile, among the above-listed charge generation materials, phthalocyanine compounds are preferable. In a case where a phthalocyanine compound is employed, when light is radiated on a photosensitive layer, the phthalocyanine compound contained in the photosensitive layer absorbs photons, thereby generating carriers. At this time, the phthalocyanine compound can, by virtue of having high quantum efficiency, absorb the photons and generate carriers efficiently.

Examples of the binder resin to be used in the charge generation layer include polycarbonate resins such as bisphenol A type and bisphenol Z type, as well as copolymers thereof, polyallylate resins, polyester resins, methacrylic resins, acrylic resins, polyvinyl chloride resins, polystyrene resins, polyvinyl acetate resins, styrene-butadiene copolymer resins, vinylidene chloride-acrylonitrile copolymer resins, vinyl chloride-vinyl acetate-maleic anhydride resins, silicone resins, silicone-alkyd resins, phenol-formaldehyde resins, styrene-alkyd resins, and poly-N-vinylcarbazole.

These binder resins can be used singly or in combination of two or more. The compounding ratio (charge generation material: binder resin) of the charge generation material in relation to the binder resin preferably falls within the range of 10:1 to 1:10 by weight. In addition, in general, the thickness of the charge generation layer preferably falls within the range of 0.01 to 5 μm; more preferably within the range of 0.05 to 2.0 μm.

The charge generation layer may contain at least one type of electron-accepting material for the purpose of enhancing sensitivity, depressing residual potential, lowering fatigue during repeated use, and the like. Examples of the electron-accepting material for use in the charge generation layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranyl, dinitroanthraquinone, trinitro-fluorenone, picric acid, o-nitrobenzoic acid, p-nitrobenzoic acid, and phthalic acid. Among them, fluorenones, quinones, and benzene derivatives having an electron-accepting substituent, such as Cl, CN, or $NO_2$, are particularly favorable.

As a method for dispersing the charge generation material in a resin, there may be employed a method utilizing a roll mill, a ball mill, a vibratory-ball mill, an attrition mill, a sand mill, or a colloid mill.

As a solvent of a coating solution for forming the charge generation layer, known organic solvents may be used. Examples of such organic solvents include aromatic hydrocarbon solvents such as toluene and chlorobenzene; fatty alcohol solvents such as methanol, ethanol, n-propanol, isopropanol, and n-butanol; ketone solvents such as acetone, cyclohexanone, and 2-butanone; halogenated aliphatic hydrocarbon solvents such as methylene chloride, chloroform, and ethylene chloride; cyclic or straight-chain ether solvents such as tetrahydrofurane, dioxane, ethylene glycol, and diethyl ether; and ester solvents such as methyl acetate, ethyl acetate, and n-butyl acetate.

As the charge transport layer, a charge transport layer formed in accordance with a known technique can be employed. The charge transport layer may be formed either from a charge transport material and a binder resin, or from a polymer charge transport material.

Examples of the charge transport material include electron-transport compounds and positive-hole transport compounds. Examples of the electron-transport compounds include quinone compounds, such as p-benzoquinone, chloranil, bromanil, and anthraquinone; tetracyanoquinodimethane compounds; fluorenone compounds, such as 2,4,7-trinitrofluorenone; xanthone compounds; benzophenone compounds; cyanovinyl compounds; and ethylene compounds. Examples of the positive-hole transport compounds include triarylamine compounds; benzidine compounds; arylalkane compounds; aryl-substituted ethylene compounds; stilbene compounds; anthracene compounds; and hydrazone compounds.

These charge transport materials can be used either singly or in combination of two or more, and no limitation is imposed thereon. These charge transport materials may be used either singly or in combination of two or more; however, in view of mobility, materials represented by, e.g., the following formulas (1) to (3), are preferably employed.

Formula (1)

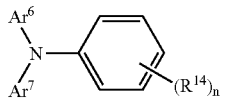

In Formula (1), $R^{14}$ represents a hydrogen atom or a methyl group, and "n" is 1 or 2. Each of $Ar^6$ and $Ar^7$ represents a substituted or unsubstituted aryl group, —C($R^{18}$)═C($R^{19}$)($R^{20}$), or —CH═CH—CH═C $(Ar)_2$, wherein the substituent is a halogen atom, an alkyl group having one to five carbon atoms, an alkoxy group having one to five carbon atoms, or a substient amino group substituted with an alkyl group having one to three carbon atoms.

Formula (2)

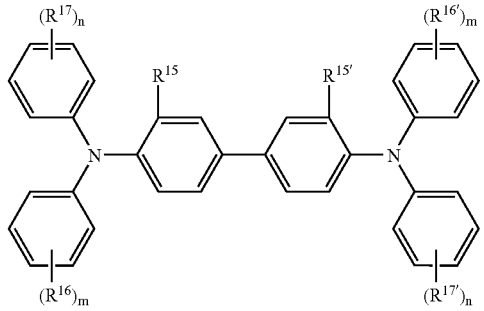

In Formula (2), each of $R^{15}$ and $R^{15'}$, which may be identical or different from each other, represents a hydrogen atom, a halogen atom, an alkyl group having one to five carbon atoms, or an alkoxy group having one to five carbon atoms. Each of $R^{16}$, $R^{16'}$, $R^{17}$, and $R^{17'}$, which may be identical or different from each other, represents a hydrogen atom, a halogen atom, an alkyl group having one to five carbon atoms, an alkoxy group having one to five carbon atoms, an amino group substituted with an alkyl group having one or two carbon atoms, a substituted or unsubstituted aryl group, —C($R^{18}$)═C($R^9$)($R^{20}$), or —CH═CH—CH═C$(Ar)_2$.

Meanwhile, with regard to the substituents in Formulas (1) and (2), each of $R^{18}$, $R^{19}$, and $R^{20}$ represents a hydrogen atom, a substituted or unsubstituted alkyl group, or a substituted or unsubstituted aryl group, wherein each of "m" and "n" is an integer from zero to two.

Formula (3)

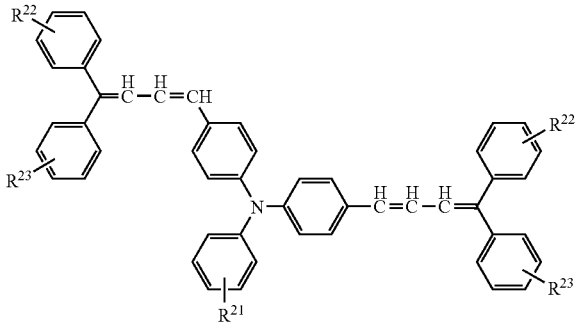

In Formula (3), $R^{21}$ represents a hydrogen atom, an alkyl group having one to five carbon atoms, an alkoxy group having one to five carbon atoms, a substituted or unsubstituted aryl group, or —CH═CH—CH═C$(Ar)_2$.

Each of $R^{22}$ and $R^{23}$, which may be identical or different from each other, represents a hydrogen atom, a halogen atom, an alkyl group having one to five carbon atoms, an alkoxy group having one to five carbon atoms, an amino group substituted with an alkyl group having one or two carbon atoms, or a substituted or unsubstituted aryl group.

Meanwhile, with regard to the substituents in Formulas (1) to (3), Ar represents a substituted or unsubstituted aryl group.

Examples of the binder resin for use in the charge transport layer include polymer charge transport materials, such as polycarbonate resins, polyester resins, methacrylic resins, acrylic resins, polyvinyl chloride resins, polyvinylidene chloride resins, polystyrene resins, polyvinyl acetate reins, styrene-butadiene copolymers, vinylidene chloride-acrylonitrile copolymers, vinyl chloride-vinyl acetate copolymers, vinyl chloride-vinyl acetate-maleic acid anhydride copolymers, silicone resins, silicone-alkyd resins, phenol-formaldehyde resins, styrene-alkyd resins, poly-N-vinylcarbazole, polysilane, and polyester polymer charge transport materials disclosed in JP-A-8-176293 or JP-A-8-208820. These binder resins may be used singly or in combination of two or more. The compounding ratio (weight ratio) of the charge generation material in relation to the binder resin preferably falls within the range of 10:1 to 1:5.

Alternatively, a polymer charge transport material may be employed singly. As the polymer charge-transport material, a known material having a charge-transporting property, such as poly-N-vinylcarbazole or polysilane, can be employed. In particular, polyester polymer charge transport materials disclosed in JP-A-8-176293 and JP-A-8-208820 have high charge-transporting properties, and are particularly preferable. The polymer charge transport material can be used as a charge transport layer only when employed singly. However, the same may alternatively mixed with the binder resin, to thus form a charge transport layer.

In general, the thickness of the charge transport layer preferably falls within the range of 5 to 50 μm; more preferably 10 to 30 μm. As a coating method, there may be employed a customarily employed method, such as a blade coating method, a Meyer bar coating method, a spray coating method, an immersion coating method, a bead coating method, an air-knife coating method, or a curtain coating method. Examples of a solvent for use indisposing the charge transport layer include ordinary organic solvents; e.g., aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or straight-chain ethers such as tetrahydrofurane and ethylether. These solvents may be used singly or in combination of two or more.

In addition, the outermost surface of the image carrier is preferably formed from a layer containing particles of a fluororesin such as PTFE (polytetrafluoroethylene), or a layer containing a resin having a crosslinked structure.

When the photosensitive layer of the image carrier is a separated-function-type photosensitive layer in which a charge generation layer and a charge transport layer are laminated in this order, fluororesin particles may be contained in the charge transport layer; alternatively, a resin having a crosslinked structure may be contained in a surface-protective layer disposed on the charge transport layer.

When a charge transport layer containing fluororesin particles is disposed on the surface of the image carrier, a frictional force between the cleaning blade and the surface of the image carrier is reduced. Accordingly, damage to and abrasion of the surface of the image carrier are suppressed, as are attrition and chipping of the tip of the edge of the cleaning blade, thereby further prolonging the useful life of the image carrier. In addition, a gap between the image carrier and the cleaning blade which may otherwise develop can be suppressed, thereby further prolonging a period during which cleaning performance can be ensured.

When fluororesin particles are to be contained in a charge transport layer, the content of the fluoreresin particles preferably falls within the range of 0.1 to 40% by weight with respect to the total weight of materials constituting the charge transport layer, more preferably 1 to 30% by weight, particularly preferably 3 to 10% by weight. When the content is less than 0.1% by weight, in a case where an electrifying device of the image carrier is a contact-type electrifying device, abrasion-reduction effect effected by dispersion of the fluororesin particles may be insufficient. Meanwhile, when the content exceeds 40% by weight, light transmittance and charge transport property of the charge transport layer decrease remarkably; and, furthermore, increase in residual potential resulting from repeated use may occur.

Meanwhile, examples of fluororesin particles that can be employed in the invention include tetrafluoroethylene resins, chlorotrifluoroethylene resins, hexafluoropropylene resins, vinyl fluoride resins, vinylidene fluoride resins, and dichlorodifluoroethylene resins, as well as copolymers thereof; and preferably one or plural these resins are selected appropriately. In particular, tetrafluoroethylene resins and vinylidene fluoride resins are preferable.

In addition, a primary particle size of the fluororesin particles preferably falls within the range of 0.05 to 1 μm, more preferably 0.1 to 0.5 μm. When the primary particle size is less than 0.05 μm, on some occasions, aggregation is likely to be accelerated during dispersion; and when the same exceeds 1 μm, on some occasions, defects in terms of image quality are likely to occur.

When a surface-protective layer containing a resin having a crosslinked structure is disposed on the surface of the image carrier, examples of the resin having a crosslinked structure include phenol resins, urethane resins, and siloxane resins, all of which have a crosslinked structure. Since these resins, having crosslinked structures, exhibit excellent abrasion resistance, abrasion of or damage to the surface of the image carrier can be suppressed even during long-term service.

In addition, from the viewpoints of electrical characteristics, image-quality-retaining property, and the like, the resin having a crosslinked structure preferably has a charge-transporting property (i.e., contains a structural unit having a charge-transport capability). In this case, when the image carrier is configured such that a charge generation layer and a charge transport layer are laminated, in this order, and that a layer containing a resin having a crosslinked structure is formed on the surface of the charge transport layer, the layer, which contains the resin having a crosslinked structure and which forms the surface of the image carrier, can also function as a portion of the charge transport layer.

As such a resin which contains a structure unit having a charge-transporting capability and which has a crosslinked structure, a siloxane resin is particularly preferable. No specific limitations are imposed on the structure of the resin; however, e.g., a resin represented by the following General Formula (I) can be utilized.

G-D-F, General Formula (I)

where in General Formula (I), G represents an inorganic glassy network subgroup, D represents a flexible organic subunit, and F represents a charge-transporting subunit.

Examples of the charge-transporting subunit include triarylamine compounds, benzidine compounds, arylalkane compounds, aryl-substituted ethylene compounds, stilbene compounds, anthracene compounds, hydrazone compounds, quinone compounds, fluorenone compounds, xanthone compounds, benzophenone compounds, cyanovinyl compounds; and ethylene compounds. Among them, in view of combination with the charge transport layer of the electrophotographic photosensitive material of the present invention, triarylamine compounds are preferably employed.

Meanwhile, examples of the inorganic glassy network subgroup include a structure which has an Si group having reactivity. The Si group causes a crosslinking reaction, thereby forming three-dimensional Si—O—Si bonding.

The flexible organic subunit imparts appropriate flexibility to the inorganic glassy network which is hard but brittle. Specific examples of the flexible organic subunit include straight-chained alkylenes and unsaturated hydrocarbon groups.

Second Embodiment

Next, an image forming apparatus according to a second embodiment will be described by reference to FIGS. 5 to 8.

Figure 5:
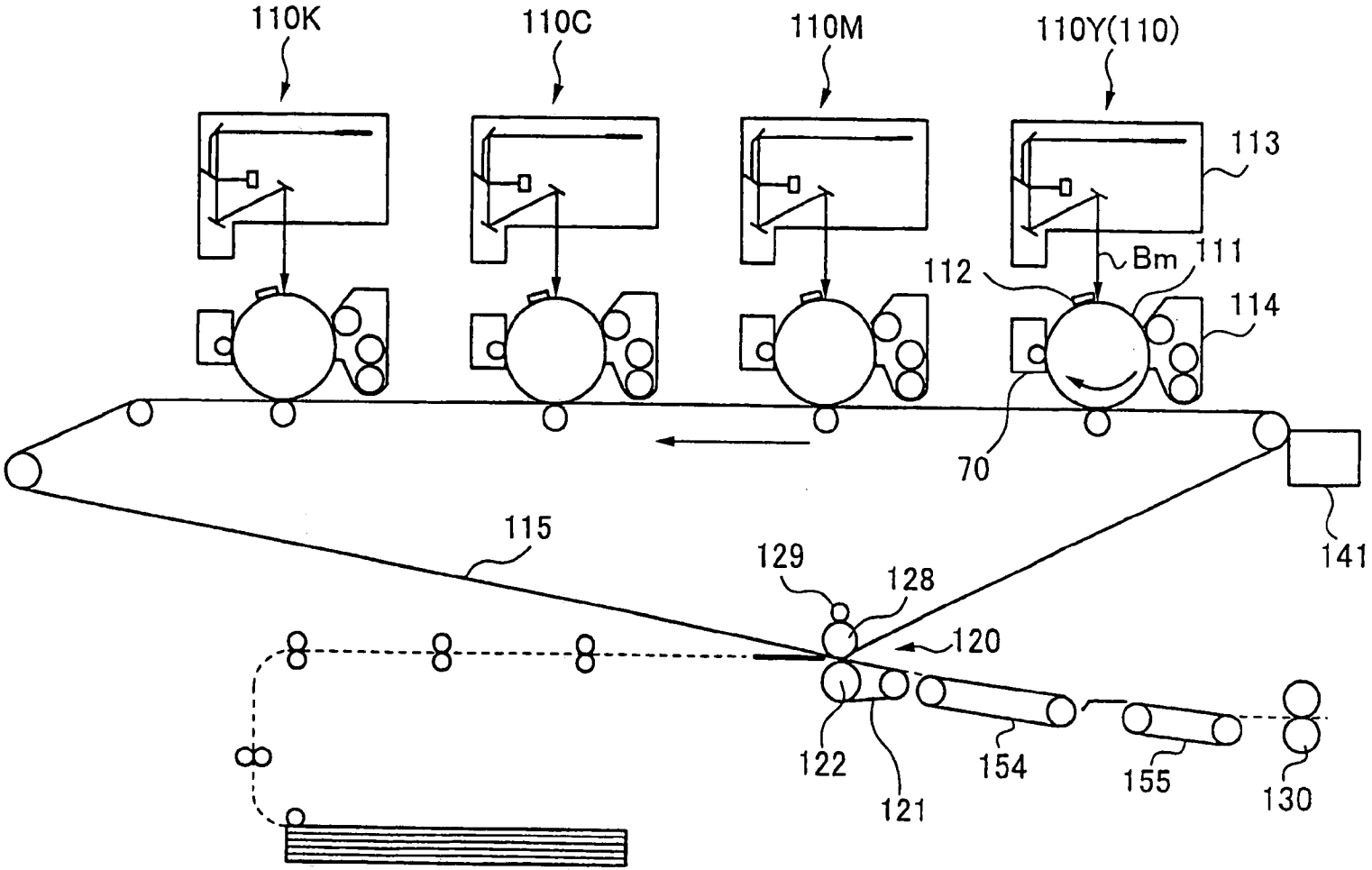
FIG. 5 is a diagram showing the overall configuration of an image forming apparatus to which a second embodiment is applied.

FIG. 5 is a diagram showing the overall configuration of the image forming apparatus according to the second embodiment. Like the image forming apparatus illustrated in FIG. 1, the image forming apparatus illustrated in FIG. 5 is a tandem-type digital color printer. In addition, the image forming apparatus illustrated in FIG. 1 is a desktop-type apparatus characterized by being configured compact in overall shape; and the image forming apparatus illustrated in FIG. 5 is a floor-standing-type apparatus characterized by enabling high-speed printing. More specifically, the image forming apparatus illustrated in FIG. 1 attains miniaturization by means of causing the ROS 30 to be used by the four image forming units 11Y, 11M, 11C, and 11K as an optical system unit in a shared manner, and disposing the discharge tray 48 on the top face of the main body 1. Meanwhile, the image forming apparatus illustrated in FIG. 5 enables high-speed printing by means of disposing an ROS 113 for each of four image forming units 110Y, 110M, 110C, and 110K; and securing a relatively large gap between a secondary transfer section 120 and a fuser 130, thereby disposing transport belts 154 and 155.

In addition, the intermediate transfer belt 21 of the image forming apparatus illustrated in FIG. 1 is located above the image forming units 11Y, 11M, 11C, and 11K. In contrast, an intermediate transfer belt 115 of the image forming apparatus illustrated in FIG. 5 is located below the image forming units 11Y, 11M, 11C, and 11K.

Operations of the image forming apparatus illustrated in FIG. 5 will be described briefly.

The surfaces of photosensitive drums 111 of the image forming units 110Y, 110M, 110C, and 110K are charged by an electrifying device 112, and thereafter the surfaces are subjected to scanning exposure by means of the ROS 113, whereby electrostatic latent images are formed. The thus-formed electrostatic latent images are developed as respective color toner images constituted of yellow (Y), magenta (M), cyan (C), and black (K) by the respective image forming units 110Y, 110M, 110C, and 110K.

The toner images formed on the photosensitive drums 111 of the image forming units 110Y, 110M, 110C, and 110K are transferred onto the intermediate transfer belt 115 by a primary transfer section where each of the photosensitive drums 111 comes into contact with the intermediate transfer belt 115. Thus, the un-fused toner images having been primarily transferred are transported to the secondary transfer section 120 by means of rotation of the intermediate transfer belt 115.

Meanwhile, residual toner remaining on the photosensitive drums 111 after the primary transfer is removed by a cleaning device 70.

At the secondary transfer section 120, while timing to secondary transfer onto recording paper is adjusted, a driving roll 121 is pressed against a back-up roll 128 while sandwiching a semiconductive secondary-transfer-transport belt 121 and the intermediate transfer belt 115 therebetween. At this time, recording paper having been transported in a timing-adjusted manner is nipped between the intermediate transfer belt 115 and the secondary-transfer-transport belt 121. At this time, when a voltage of the same polarity (a normal transfer bias) as the charged polarity of toner is applied to a power-supply roll 129, a transfer electric field is formed on the secondary-transfer-transport belt 121 as an opposing electrode. Accordingly, at a secondary transfer position pressed between the driving roll 122 and the back-up roll 128, the non-fused toner images having been carried on the intermediate transfer belt 115 are electrostatically transferred on the recording paper.

Thereafter, the recording paper on to which the toner image is electrostatically transferred is transported while in a state of being peeled off from the intermediate transfer belt 115 by the secondary-transfer-transport belt 121, to thus be transported at constant speed to a transport belt 154 disposed downstream of the secondary-transfer-transport belt 121 with respect to the transport direction of paper. When the recording paper is transported to a terminal end of the transport belt 154, the same is conveyed to a transport belt 155. The transport belt 155, the speed of which is changed in accordance with an optimum transport speed for the fuser 130, transports the recording paper to the fuser 130. The un-fused toner image on the recording paper is subjected to fixation processing by means of the fuser 130 by heat and pressure, to thus be fused on the recording paper. The recording paper on which a fused image is formed is discharged to the outside of the apparatus by means of an unillustrated discharge roll.

Meanwhile, after completion of transfer operation to the recording paper, residual toner remaining on the intermediate transfer belt 115 is transported to the cleaning section by means of rotational motion of the intermediate transfer belt 115; and removed from the intermediate transfer belt 115 by means of a belt cleaner 141.

Figure 6:
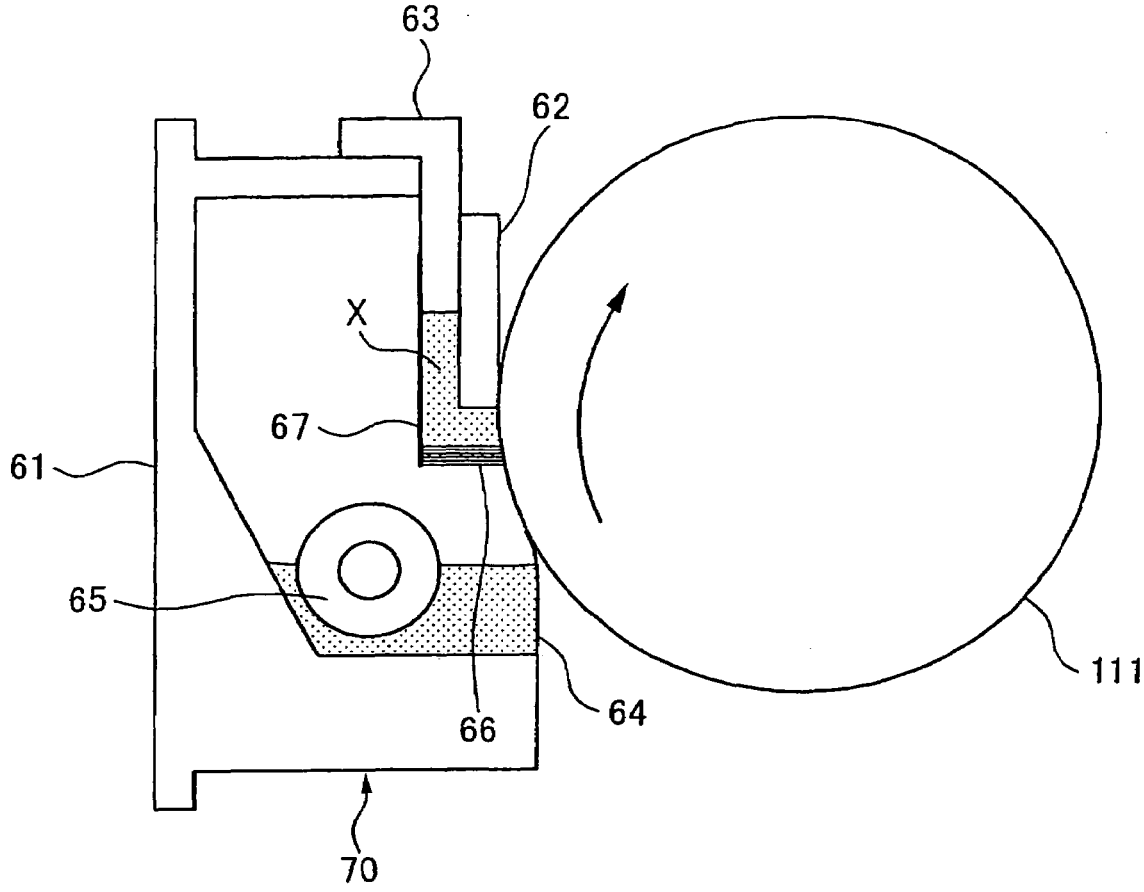
FIG. 6 is a configuration diagram for explaining the configuration of another cleaning device.

FIG. 6 is a configuration diagram showing the configuration of the cleaning device 70 for use in the image forming apparatus of the second embodiment.

As illustrated in FIG. 6, like the cleaning device 60 illustrated in FIG. 3, the cleaning device 70 has the cleaning case 61, the cleaning blade 62, the bracket 63, the sealing member 64, the transport auger 65, the tone-feeding section 66, the toner-regulation member 67, and the region X.

The cleaning device 70 differs in layout from the cleaning device 60 in FIG. 3 so as to adapt to a rotation direction of the photosensitive drum 111. More specifically, in the image forming apparatus illustrated in FIG. 1, the intermediate transfer belt 21 is located above the photosensitive drums 12 (see FIG. 1); and the intermediate transfer belt 21 in the primary transfer section rotationally moves from the right to the left as viewed from the front side (see FIG. 1). In contrast, in the image forming apparatus illustrated in FIG. 5, the intermediate transfer belt 115 is located below the photosensitive drums 111 (see FIG. 5); and the intermediate transfer belt 115 in the primary transfer section rotationally moves from the left to the right as viewed from the front side (see FIG. 5). As described above, the image forming apparatus illustrated in FIG. 1 and the same illustrated in FIG. 5 have opposite layouts in terms of the configuration of the cleaning devices 60 and the cleaning device 70, as a result of the rotation direction of the photosensitive drum 12 and that of the photosensitive drums 111 being opposite.

By virtue of the above configuration, the cleaning device 70 exhibits the same working effects as those of the previously mentioned cleaning device 60.

Figure 7:
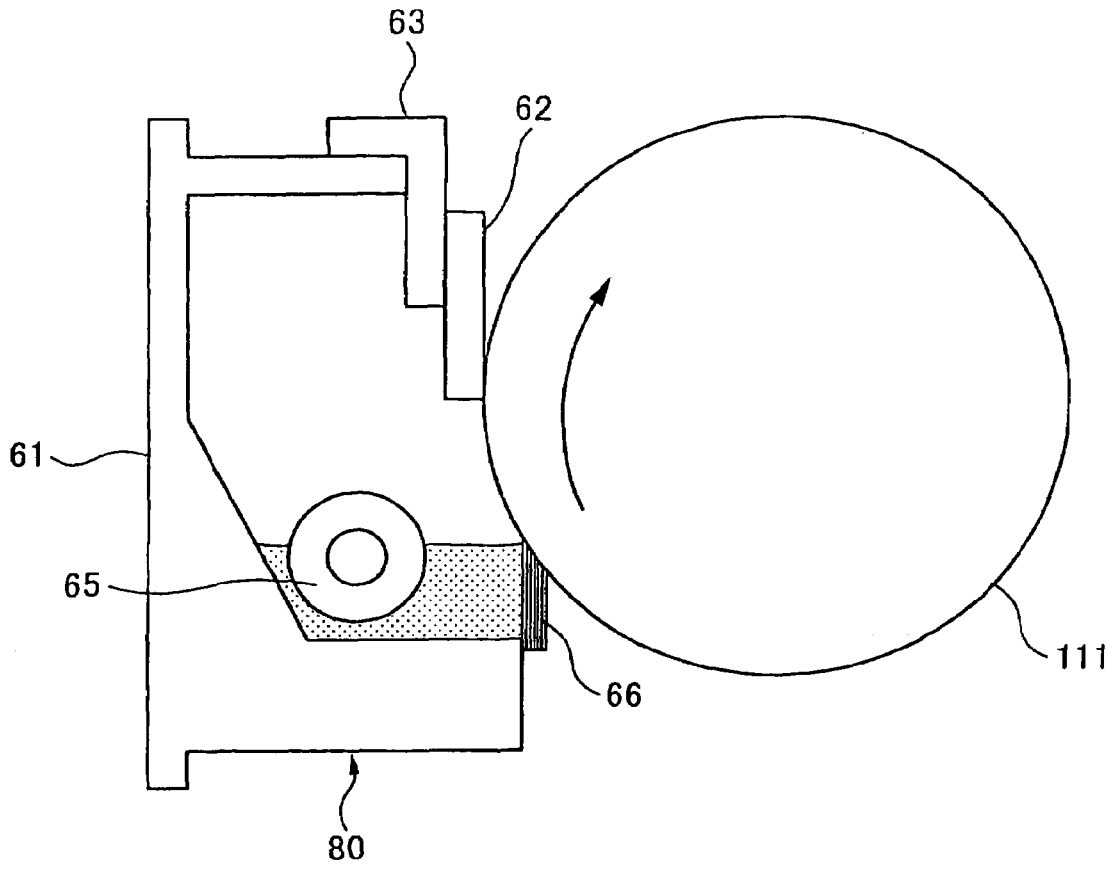
FIG. 7 is a configuration diagram for explaining the configuration of another cleaning device.

FIG. 7 is a configuration diagram showing the configuration of a cleaning device 80 for use in the image forming apparatus of the second embodiment.

As illustrated in FIG. 7, the cleaning device 80 is substantially identical in basic configuration with the cleaning device 70 illustrated in FIG. 6. More specifically, the cleaning device 80 includes the cleaning case 61, the cleaning blade 62, the bracket 63, the transport auger 65, and the toner feeding section 66. However, the cleaning device 80 is not provided with the sealing member 64 and the toner-regulation member 67, which are provided in the cleaning device 70 illustrated in FIG. 6. Descriptions in this aspect are as follows. The cleaning device 70 illustrated in FIG. 6 provides the respective functions of the sealing member 64 and of the toner-regulation member 67 included in the cleaning device 70 illustrated in FIG. 6. Accordingly, the cleaning device 80 can have the same working effects as those of the cleaning device 70 illustrated in FIG. 6 with use of a further simplified configuration.

The cleaning blade 62 according to an example which will be described hereinbelow is a more specific example of the above-mentioned first embodiment and second embodiment. In addition, the cleaning blade 62 is configured as described hereinbelow; however, the present invention is not limited to these examples.

Preparation of Photosensitive Material

<Photosensitive Material A>

To 170 parts by weight of n-butyl alcohol, in which 4 parts by weight of a polyvinylbutyral resin (S-LEC BM-S, manufactured by Sekisui Chemical Co., Ltd.) was dissolved, 30 parts by weight of an organic zirconium compound (acetylacetone zirconium butyrate) and 3 parts by weight of an inorganic silane compound (γ-aminopropyltrimethoxysilane) were added. The mixture was mixed by stirring, thereby obtaining a coating solution for forming an undercoating layer.

This coating solution was dip-coated on an aluminum substrate having outer diameter of 40 mm and a surface having been roughened through a honing process; and air-dried at a room temperature for five minutes. Thereafter, the temperature of the substrate was raised to 50° C. over 10 minutes, and placed in a bath having a constant temperature of 50° C. and a constant humidity of 85% RH (dew point 47° C.), thereby performing wet-hardening acceleration treatment for 20 minutes. Thereafter, the substrate was placed in a hot-air dryer where the substrate was dried at 170° C. over 10 minutes, thereby forming an undercoating layer.

As the charge generation material, chlorogallium phthalocyanine was employed; and a mixture constituted of 15 parts by weight chlorogalliumphthalocyanine, 10 parts by weight of a vinyl chloride-vinyl acetate copolymer resin (VMCH, manufactured by Japan Union Carbide Corporation), and 300 parts by weight n-butyl alcohol was dispersed by means of a sand mill for four hours, thereby obtaining a dispersion. The dispersion was dip-coated on the undercoating layer and dried, thereby forming a charge generation layer having a film thickness of 0.2 μm.

Next, a coating solution, obtained by means of sufficiently dissolving and mixing 40 parts by weight N,N'-bis (3-methylphenyl)-N,N'-diphenylbenzidine and 60 parts by weight bisphenol Z polycarbonate resin (molecular weight: 40,000) in 235 parts by weight tetrohydrofuran and 100 parts by weight monochlorobenzene, was dip-coated on the aluminum substrate on which the charge generation layer had been formed, and dried at 120° C. for 40 minutes, to thus form a charge transport layer having a film thickness of 24 μm, thereby obtaining a photosensitive material A.

<Photosensitive Material B>

Forty parts by weight N,N'-bis (3-methylphenyl)-N,N'-diphenylbenzidine and 60 parts by weight of a bisphenol Z polycarbonate resin (molecular weight: 40,000) were sufficiently dissolved and mixed in 280 parts by weight tetrohydrofuran and 120 parts by weight toluene, and thereafter 10 parts by weight tetrafluoroethylene was added thereto, and further mixed.

At this time, the room temperature was set to 25° C., and a liquid temperature during mixing was maintained at 25° C. Thereafter, the mixture was dispersed by means of a sand grinder with use of glass beads, thereby forming a tetrafluoroethylene particle dispersion. At this time, water of 24° C. was fed to a vessel of the sand grinder, thereby maintaining the temperature of the dispersion at 50° C.

The thus-obtained coating solution was dip-coated on the surface of a cylindrical substrate on which the charge generation layer had been formed, in the same manner as in the case of the photosensitive material A, and dried at 120° C. for 40 minutes, to thus form a charge transport layer having a film thickness of 25 μm, thereby obtaining a photosensitive material B.

<Photosensitive Material C>

Two parts by weight of the compound of Formula (4) and 2 parts by weight RESITOP PL-4852 (manufactured by Gunei Chemical Industry Co., Ltd.) were dissolved in 10 parts by weight isopropyl alcohol, thereby obtaining a coating solution for forming a protective layer. The coating solution for forming a protective layer was dip-coated on a charge transport layer having been fabricated under the same conditions as those of the photosensitive material A, except that the coating transport layer had been formed so as to have a film thickness of 22 μm. The coating was air-dried at room temperature for 30 minutes, and thereafter dried at 140° C. for 60 minutes, to thus form a protective layer having a film thickness of 4 μm, thereby obtaining a photosensitive material C.

Formula (4)

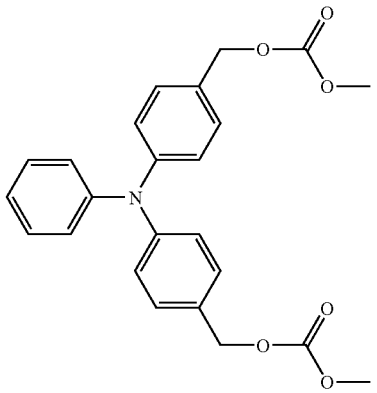

The above photosensitive materials A to C were attached to an image forming apparatus (DocuCenter Color 400CP or DocuColor 1250, manufactured by Fuji Xerox Co., Ltd.), and a variety of evaluations were performed.

EXAMPLE 1

In the configuration where toner removed by the cleaning blade 62 is likely to accumulate on the tip of the cleaning blade 62 as illustrated in FIG. 3, the toner feeding section 66 formed from a conductive brush is in contact with the surface of the photosensitive drum 12 upstream of the cleaning blade 62 with respect to the rotational direction of the photosensitive drum 12, and applies −9 μA in the same polarity as that of toner. Toner obtained through cleaning is retained at a portion surrounded by the cleaning blade 62, the toner feeding section 66, and the toner-regulation member 67. Toner at a portion which has been brought into contact with the toner feeding section 66 is charged again, and electrostatically attached onto the surface of the photosensitive material, thereby being fed to a tip of an edge of the cleaning blade 62. Meanwhile, on the toner-regulation member 67, the notches 67*a* for discharging toner are disposed so as to allow passage therethrough of an appropriate amount of the retained toner.

For evaluation of abrasion of an edge during actual use, photosensitive material A and the DocuCenter Color 400 CP manufactured by Fuji Xerox Co., Ltd were employed. Since stress is applied to the edge in a condition where friction between the photosensitive drum 12 and the cleaning blade 66 is high, an abrasion area of an edge tip of the cleaning blade 62 was measured under a high-temperature, high-pressure environment (28° C., 85% RH), and after the photosensitive drum 12 was driven for 100,000 (100K) cycles at an image density of 1%, which is such an image density that feeding of toner—which provides a lubricant effect—is reduced to a minimum value. The abrasion area was obtained by means of measuring, over a cross section of the cleaning blade 62, areas on a cut-face side and a mirror-face side having been chipped due to rubbing with the photosensitive drum.

Meanwhile, evaluation of performance in cleaning toner was performed as follows. An untransferred solid image of 400 mm was caused to enter. Immediately after the rear end of the image had passed the cleaning blade 62, the machine was stopped, and absence/presence of passed-through toner was evaluated.

FIG. 8 shows the results with regard to an abrasion area of an edge and cleaning performance in Example 1. As illustrated in FIG. 8, the abrasion area of the edge was small, and cleaning performance was also satisfactory.

EXAMPLE 2

In the configuration where toner removed by the cleaning blade 62 easily falls under the force of gravity as illustrated in FIG. 6, the toner feeding section 66 formed from a conductive brush is in contact with the surface of the photosensitive drum 12 upstream of the cleaning blade 62 with respect to the rotational direction of the photosensitive drum 12, and applies −9 μA in the same polarity as that of the toner. Toner obtained through cleaning is retained at a portion surrounded by the cleaning blade 62, the toner feeding section 66, and the toner regulation member 67. Toner at a portion which has been brought into contact with the toner feeding section 66 is charged again, and electrostatically attached on the surface of the photosensitive material, thereby being fed to the tip of the edge of the cleaning blade 62. Meanwhile, on the toner-regulation member 67, the notches 67*a* for discharging toner are disposed so as to allow passage therethrough of an appropriate amount of the retained toner.

For evaluation of abrasion of an edge in actual use, the same evaluations of abrasion of edge and cleaning performance as in Example 1 were performed with use of the photosensitive material A and a modified machine in which a contact-type electrifying device is mounted on DocuColor 1250 manufactured by Fuji Xerox Co., Ltd.

Meanwhile, a driving distance of the photosensitive drum 12 in relation to the cleaning blade 62 was set to the same value as in Example 1, and stress resulting from discharge of the contact-type electrifying device, the amount of used toner, and the photosensitive material were also set to the same values as in Example 1.

As illustrated in FIG. 8, also in Example 2, the abrasion area of the edge was small, and cleaning performance was satisfactory.

EXAMPLE 3

In the configuration where toner removed by the cleaning blade 62 easily falls under the force of gravity as illustrated in FIG. 7, the toner feeding section 66—which is disposed upstream of the cleaning blade 62 with respect to the rotational direction of the photosensitive drum 12, and which is formed from a conductive brush serving also as the sealing member 64 for effecting sealing so as to prevent leakage of toner—is in contact with the surface of the photosensitive drum 12, and applies −9 μA in the same polarity as that of the toner. In the vicinity of the toner feeding section 66, toner obtained through cleaning is retained in all cases. Toner at a portion which has been brought into contact with the toner feeding section 66 is charged again, and electrostatically attached on the surface of the photosensitive material, thereby being fed to a tip of the edge of the cleaning blade 62.

For evaluation of abrasion of an edge in actual use, the same evaluations of abrasion of edge and cleaning performance as in Example 1 were performed with use of the photosensitive material A and a modified machine—in which a contact-type electrifying device is mounted on DocuColor 1250 manufactured by Fuji Xerox Co., Ltd.

Meanwhile, a driving distance of the photosensitive drum 12 in relation to the cleaning blade 62 was set to the same value as in Example 1, and discharge stress of the contact-type electrifying device, the amount of used toner, and the photosensitive material were also set to the same values as in Example 1.

As illustrated in FIG. 8, also in Example 3, the abrasion area of the edge was small, and cleaning performance was satisfactory.

EXAMPLE 4

In the same manner as in Example 1, evaluations of abrasion of edge and cleaning performance were performed with use of the photosensitive material B. As illustrated in FIG. 8, in Example 4, the abrasion area of the edge was smaller than in Example 1, and cleaning performance was also satisfactory. This is considered to be ascribable to the fluororesin on the surface of the photosensitive material, which reduced friction between the photosensitive drum 12 and the cleaning blade 62.

EXAMPLE 5

In the same manner as in Example 1, evaluations of abrasion of edge and cleaning performance were performed with use of the photosensitive material C. As illustrated in FIG. 8, the photosensitive material C, which was high in mechanical strength, encounters difficulty in removal of corona products. In addition, increase in friction was large and the abrasion wear of the edge was somewhat larger than that of Example 1.

However, lubricant effect was exerted sufficiently, and cleaning performance was also satisfactory.

COMPARATIVE EXAMPLE 1

Figure 9:
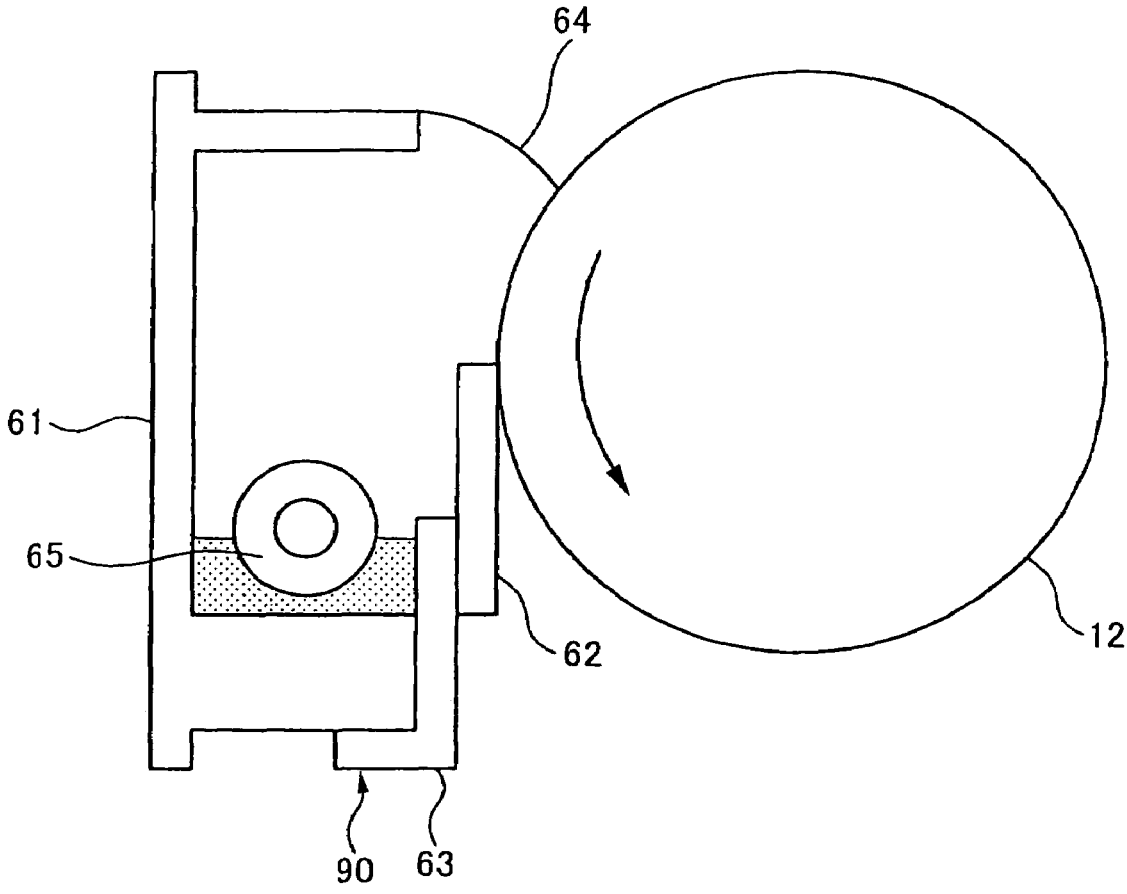
FIG. 9 is a configuration diagram for explaining the configuration of a cleaning device in a Comparative Example.

As illustrated in FIG. 9, evaluations of abrasion of edge and cleaning performance were performed with use of the cleaning device 90. In contrast to the cleaning devices 60 and 70, the cleaning device 90 is provided with neither the toner feeding section 66 nor the toner-regulation member 67; and in contrast to the cleaning device 80, the cleaning device 90 is not supplied with the toner feeding section 66. Under such conditions, evaluations of abrasion of edge and cleaning performance were performed with use of the photosensitive material A. The results indicate that, as shown in FIG. 8, the abrasion area of the edge was large, and cleaning performance was insufficient.

COMPARATIVE EXAMPLE 2

In the same manner as in Comparative Example 1, evaluations were performed. However, as illustrated in FIG. 8, abrasion became high, and turning-up of a blade occurred.

The process cartridge may further include retaining unit for retaining residual toner having been removed from the surface of the member to be cleaned by means of the cleaning blade, in which case the toner feeding unit feeds to the surface the residual toner retained by the retaining unit. In addition, the toner feeding unit may constitute a portion of the retaining unit.

The image carrier may be formed from a photosensitive material having a surface layer containing a fluororesin on an outermost surface thereof. The image carrier may be formed from a photosensitive material including, on an outermost layer thereof, a protective layer which has a structural unit having a charge-transport capability and which is formed from a surface layer containing a resin having a crosslinked structure. The electrifying device may be a contact-type electrifying device which comes into contact with the image carrier, to thus effect charging.

The member to be cleaned may be an image carrier, and the process cartridge may further comprise an electrifying device that charges the image carrier.

The process cartridge may further comprise a developing device that develops an electrostatic latent image formed on the image carrier with a toner.

The residual toner may electrostatically adheres to the surface of the member to be cleaned, and the toner feeding unit may feed the residual toner to the surface by charing the residual toner.

The cleaning method may further include a retaining step of retaining the adhesion substance having been removed in accordance with the cleaning step, in which case the feeding step feeds to the not-yet-cleaned region the adhesion substance retained in accordance with the retaining step.

The image forming apparatus may further include retaining unit for retaining the adhesion substance having been removed from the surface of the member to be cleaned by means of the cleaning blade, in which case the feeding unit feeds to the surface the deposit retained by the retaining unit.

The feeding unit can be characterized by having a conductive brush member, a conductive film member, or a conductive roller member; and in that a bias of the same polarity as that of the adhesion substance is applied to the feeding unit. The feeding unit can be characterized by having a conductive brush member to which a bias of the same polarity as that of the adhesion substance is applied, and in that a tip side of the brush member is separated from the cleaning blade so as not to enter a gap between the cleaning blade and the member to be cleaned.

The adhesion substance may electrostatically adhere to the surface, and the feeding unit may feed the adhesion substance to the surface by charging the adhesion substance.

The entire disclosure of Japanese Patent Application No. 2005-091069 filed on Mar. 28, 2005 including specification, claims, drawings and abstract is incorporated herein by reference in its entirety.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A process cartridge detachably mounted on an image forming apparatus, comprising:

a cleaning blade which comes into contact with a surface of a member to be cleaned incorporated in the image forming apparatus, and removes a residual toner adhering to the surface;

a toner feeding unit which is disposed on the cleaning blade at a side where the residual toner adheres to the surface of the member to be cleaned, and re-adheres the residual toner having been removed from the surface to the surface; the toner feeding unit is in contact with the surface of the member to be cleaned; and a bias applied to the toner feeding unit has the same polarity as that applied to the toner.

2. The process cartridge according to claim 1, further comprising:

a retaining unit that retains the residual toner having been removed from the surface of the member to be cleaned by the cleaning blade, wherein the toner feeding unit feeds the residual toner retained by the retaining unit to the surface.

3. The process cartridge according to claim 2, wherein the toner feeding unit constitutes a portion of the retaining unit.

4. The process cartridge according to claim 1, wherein the member to be cleaned is an image carrier, the process cartridge further comprising:

an electrifying device that charges the image carrier.

5. The process cartridge according to claim 4, wherein the image carrier is a photosensitive material having a surface layer containing a fluororesin on an outermost surface thereof.

6. The process cartridge according to claim 4, wherein the image carrier is a photosensitive material including a protective layer on an outermost layer thereof, wherein the protective layer has a structural unit having a charge-transport capability and is formed from a surface layer containing a resin having a crosslinked structure.

7. The process cartridge according to claim 4, wherein the electrifying device is a contact-type electrifying device which comes into contact with the image carrier to charge.

8. The process cartridge according to claim 4, further comprising:

a developing device that develops an electrostatic latent image formed on the image carrier with a toner.

9. The process cartridge detachably mounted on an image forming apparatus according to claim 1, wherein the toner feeding unit includes a brush that is in contact with the surface of the member to be cleaned.

10. An image forming apparatus comprising:

a cleaning blade which comes into contact with a surface of a member to be cleaned incorporated in the image forming apparatus, and removing a residual toner adhering to the surface;

a toner feeding unit which is disposed on the cleaning blade at a side where the residual toner adheres to the surface of the member to be cleaned, and re-adhere the residual toner having been removed from the surface to the surface; the toner feeding unit is in contact with the surface of the member to be cleaned;

wherein the residual toner electrostatically adheres to the surface of the member to be cleaned, the toner feeding unit feeds the residual toner to the surface by charging the residual toner, and a bias applied to the toner feeding unit has the same polarity as that applied to the toner.

11. The image forming apparatus according to claim 10, further comprising:

a retaining unit that retains the residual toner having been removed from the surface of the member to be cleaned by means of the cleaning blade, wherein the toner feeding unit feeds to the surface the residual toner retained by the retaining unit.

12. The image forming apparatus according to claim 11, wherein the toner feeding unit constitutes a portion of the retaining unit.

13. The image forming apparatus according to claim 10, wherein the toner feeding unit includes a brush that is in contact with the surface of the member to be cleaned.

14. A cleaning method comprising:

a feeding step of feeding an adhesion substance to a not-yet-cleaned region on a surface of a member to be cleaned by bringing a toner feeding unit to be in contact with the surface of the member to be cleaned;

a cleaning step of cleaning the not-yet-cleaned region, to which the adhesion substance has been fed in the feeding step, by a cleaning blade which comes into contact with the surface of the member to be cleaned; and applying a bias to the toner feeding unit, the applied bias having the same polarity as that applied to the toner.

15. The cleaning method according to claim 14, further comprising:

a retaining step of retaining the adhesion substance having been removed in the cleaning step, wherein the feeding step feeds the adhesion substance retained by the retaining step to the not-yet-cleaned region.

16. The cleaning method according to claim 14, wherein the toner feeding unit includes a brush that is in contact with the surface of the member to be cleaned.

17. A cleaning device comprising:

a cleaning blade which comes into contact with a surface of a member to be cleaned, and removes an adhesion substance adhering to the surface;

a feeding unit which is disposed on a side of the cleaning blade at a side where the adhesion substance adheres to the surface, and feeds the adhesion substance to the surface, the feeding unit is in contact with the surface of the member to be cleaned; and a bias applied to the toner feeding unit has the same polarity as that applied to the adhesion substance.

18. The cleaning device according to claim 17, further comprising:

a retaining unit that retains the adhesion substance having been removed from the surface of the member to be cleaned by the cleaning blade, wherein the feeding unit feeds to the surface the adhesion substance retained by the retaining unit.

19. The cleaning device according to claim 18, wherein the feeding unit constitutes a portion of the retaining unit.

20. The cleaning device according to claim 17, wherein the adhesion substance electrostatically adheres to the surface, and the feeding unit feeds the adhesion substance to the surface by charging the adhesion substance.

21. The cleaning device according to claim 20, wherein the feeding unit includes a conductive brush member, a conductive film member, or a conductive roller member, and a bias of the same polarity as that of the adhesion substance is applied to the feeding unit.

22. The cleaning device according to claim 20, wherein the feeding unit includes a conductive brush member to which a bias of the same polarity as that of the adhesion substance is applied, and a tip side of the brush member is separated from the cleaning blade so as not to enter into a gap between the cleaning blade and the member to be cleaned.

23. The cleaning device according to claim 17, wherein the feeding unit includes a brush that is in contact with the surface of the member to be cleaned.

* * * * *